United States Patent [19]

Hoyt

[11] Patent Number: 4,940,008

[45] Date of Patent: Jul. 10, 1990

[54] FOLDABLE MAST ASSEMBLY

[76] Inventor: John G. Hoyt, Two Harbor View Dr., Newport, R.I. 02840

[21] Appl. No.: 402,816

[22] Filed: Sep. 5, 1989

[51] Int. Cl.[5] ..... B63H 9/08

[52] U.S. Cl. ..... 114/39.1; 114/61; 114/90; 114/97

[58] Field of Search ..... 114/89, 90, 91, 39.1, 114/39.2, 102, 103, 61

[56] References Cited

FOREIGN PATENT DOCUMENTS

| | | | |
|---|---|---|---|
| 0075208 | 3/1983 | European Pat. Off. | 114/91 |
| 0274232 | 7/1988 | European Pat. Off. | 114/91 |
| 2535671 | 5/1984 | France | 114/91 |
| 2579557 | 10/1986 | France | 114/91 |
| 8600661 | 10/1987 | Netherlands | 114/91 |

*Primary Examiner*—Joseph F. Peters, Jr.
*Assistant Examiner*—Edwin L. Swinehart
*Attorney, Agent, or Firm*—Barlow & Barlow, Ltd.

[57] ABSTRACT

An A frame mast is pivoted relative to a sailboat hull and supports a lateen yard. A boom is coupled to the yard and to the sailboat hull at the bow. The A frame mast is supported in all positions by struts that lead from each leg of the A frame mast to slidable connections on the hull which permits the mast to be raised and lowered. In other forms, a foldable mast assembly for a sailboat uses a rotatable stub mast and a boom mounted at the upper end thereof. An A frame mast is pivoted relative to the boom and carries a lateen yard that can be raised and lowered by a halyard at the top of the mast structure. To raise and lower the mast, a pair of struts are pivoted thereto and are slidably connected to the sailboat hull or boom so that by using mechanical advantage coupled to the slidable connection, the mast be raised and lowered.

8 Claims, 1 Drawing Sheet

FOLDABLE MAST ASSEMBLY

BACKGROUND OF THE INVENTION

This invention relates to a sailboat in which the mast is foldable down into a stowed position and is particularly directed to one having a lateen rig.

In the past, there have been several attempts at having arrangements which provide a mast that will fold. This is due in part to the popularity of small sailboats which are of a size that can be readily triable.

In the prior art there are some examples of collapsible masts. In U.S. Pat. No. 3,898,948, a mast which is demountable utilizes for convenience, braces which have a slider that engage the luff track of the mast. Other examples of collapsible masts are seen in U.S. Pat. No. 4,112,861 which shows a mast that is adapted to not only pivot at the deck level but also pivot upon itself part way up the vertical extent thereof. U.S. Pat. No. 4,655,154 is a still further example of a folding mast structure and typifies more or less one of the more conventional ways of pivoting masts in tabernacles.

As noted in these prior art patents, for the most part, they all require the utilization of a fore stay together with a block and tackle for the raising and lowering process.

SUMMARY OF THE INVENTION

The present invention is designed to overcome the deficiencies of the prior art and provide a foldable mast assembly for a sailboat which utilizes the concept of a pair of struts that support a mast. In one basic form particularly for a multi-hull, the A frame mast is pivoted to the deck and is supported in all positions by a pair of struts that are pivoted to the mast, the lower ends of which slide on trackways on the deck. Other forms use a rotatable stub mast that has a boom at the upper end thereof. For some applications, the boom mounted upon the rotating stub mast is a wishbone boom. The upper part of the mast is preferably an A-frame which is pivoted to the outboard edges of the wishbone boom and this is raised and lowered by a strut, or more particularly, a pair of struts, that are pivotally mounted on the upper mast at one end thereof while the lower end is pivotally coupled to a car which rides on a track that is arranged longitudinally of the wishbone boom. The car is coupled to a means for pulling the same forward such as a block and tackle and in this way, the upper mast can be raised readily. The use of an A frame mast lends itself to a lateen rig and to this end, the lateen yard may be hingedly arranged to the forward end of the boom. By utilizing this structure, the mast may be folded to an inoperative position by pivoting aft which will automatically lower the yard and the sail to be stowed on top of the boom.

DESCRIPTION OF THE PREFERRED EMBODIMENT

Figure 2:
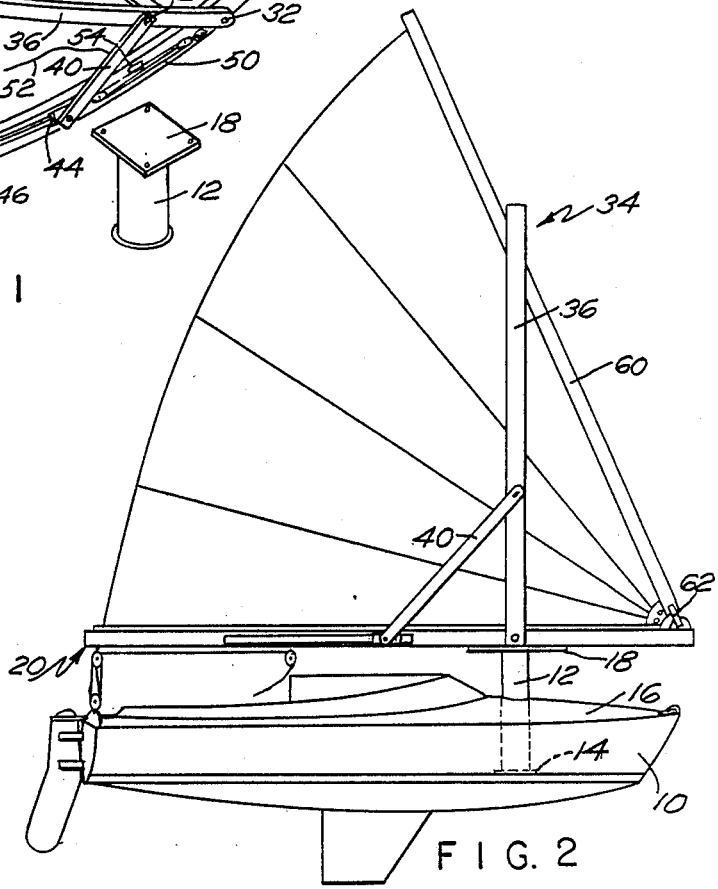
FIG. 2 is a side elevational view illustrating the rig fully raised.

The invention is directed particularly to the foldable mast assembly which is arranged to be mounted on a hull 10 of a sailboat as seen in FIG. 2. The sailboat is provided with a rotatable stub mast 12 which is received in a suitable mast step 14 and which passes through the deck 16 of the boat terminating in a top plate 18. On the top plate 18, a wishbone boom is mounted, which wishbone boom, generally indicated at 20, has a nose 22 with a pair of diverging side arms 24, 26 that connect together at the aft end by a bridging member 28 and near the nose end are interconnected by a mounting plate 30 which rests upon and is bolted to the plate 18 at the top end of the rotatable stub mast 12.

Mounted on pivot pins 32, 32' is an A frame upper mast generally designated 34 which has a pair of arms 36, 36', the lower ends of which are pivoted on the pivot 32, 32' to the wishbone boom members 24, 26, respectively. In order to raise and lower the upper mast 34, struts 40, 40' are provided which are pivoted as at 42, 42 to the members 36, 36' of the upper mast 34. The lower end of the struts are pivotally attached to track cars 44, 44', which cars settleable engage raised tracks 46, 46' that are fastened to the members 24, 26, respectively, of the wishbone boom.

Figure 1:
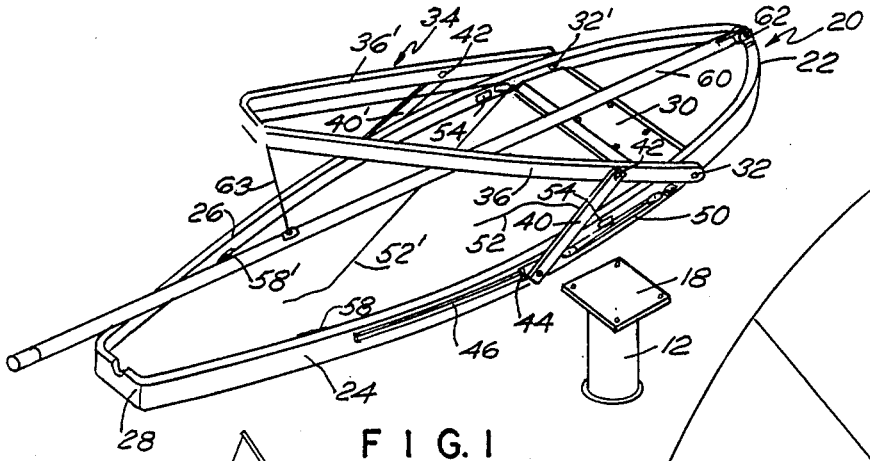
FIG. 1 is a perspective view in detached form illustrating the mast and boom arrangement.

To raise the mast into an upright position, a mechanical advantage means, generally indicated at 50 and illustrated as a block and tackle, is provided. It will be apparent to those skilled in the art that the mechanical advantage is achieved by the number of lines in the block and tackle assembly and for convenience sake, if this arrangement is utilized, the tail of the block and tackle can be passed through a sheaves 54, 54', for example, so that the tail 52 may be available to a person in the cockpit of the sailboat. Assuming that the block and tackle arrangement is utilized, the tails 52, 52' would be pulled simultaneously and when the mast is completely erected, the tails can be fastened to cleats 58, 58' located on the inner wall of the wishbone boom members 24, 26, respectively. The remaining rig may be readily elevated as the lateen 60 is pivoted as at 62 to the nose end 22 of the wishbone boom and has a halyard 63 that passes through a block at the upper end of the A-frame mast 34. This arrangement is illustrated somewhat in FIG. 1 and can be readily understood by viewing FIGS. 2 and 3 of the drawings. It should also be noted that when the yard is raised, as seen in FIG. 2, that a structural tripod is formed by the wishbone boom, the yard that is pivoted and accordingly coupled to the boom, and the mast through the yard and halyard connection at the apex thereof.

Figure 3:
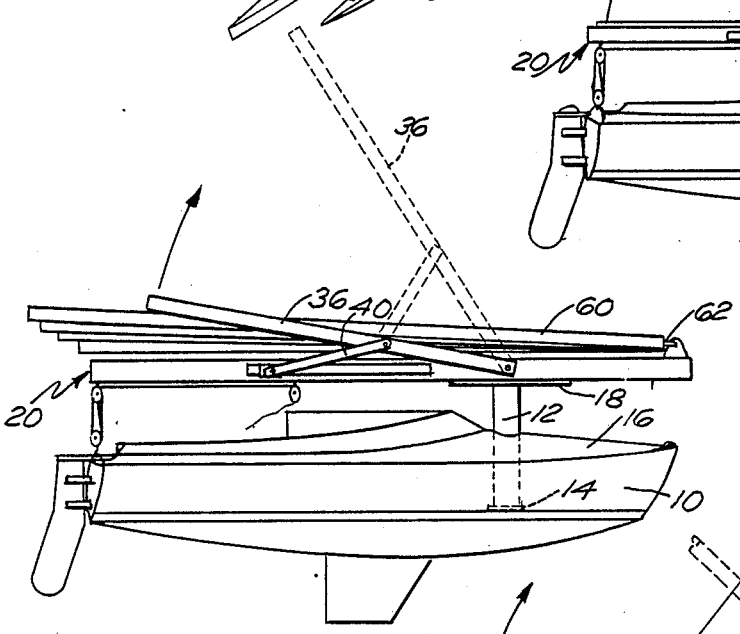
FIG. 3 is a view of the rig in folded condition.

For lowering the rig a reverse procedure would be utilized to that described above. First, the lateen yard halyard would be released lowering the lateen yard and the sail onto the boom and then the A-frame mast may be lowered by releasing the tails 52, 52' so that the upper mast may will be stowed as seen in FIG. 3 of the drawings.

Figure 4:
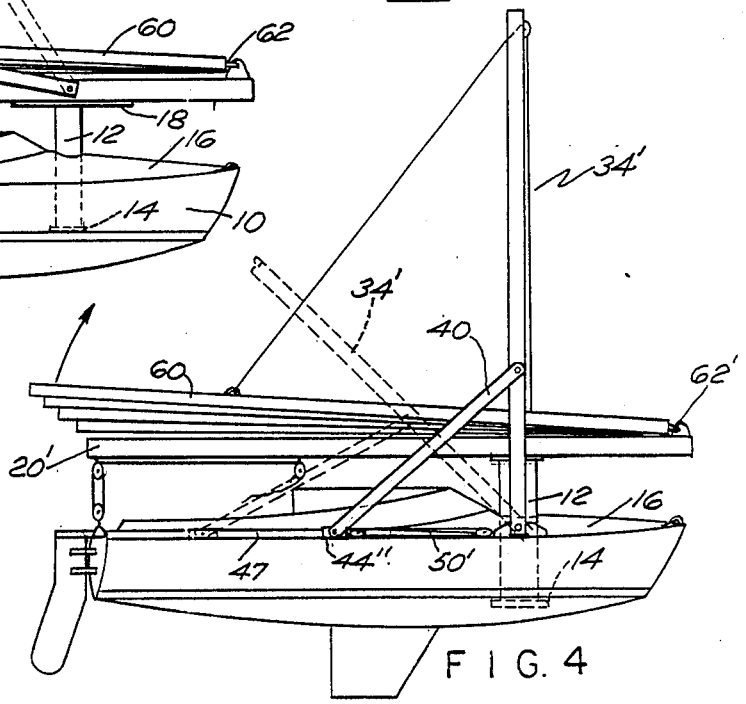
FIG. 4 is an elevational view of another form.

Referring to FIG. 4 of the drawings, a stub mast 12' has a boom 20' fastened at the upper end thereof. The boom may be a single spar or a wishbone as described above. The boom extends forward and at 62', a lateen yard 60' is pivoted, to be hoisted by a halyard 63'. The mast 34' in this case is pivoted to the deck by a pivot standard and will be an A frame as above. The mast 34' will be supported by a pair of struts 40' for all movement. The struts are pivoted to the mast 34' and are attached by cars 44'' to deck mounted trackway 47. The struts and the mast form a tripod-like framework which is structurally sound and permits the mast to operate without any shrouds.

Figure 5:
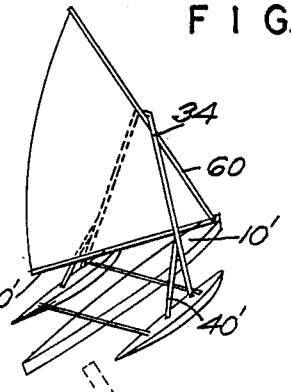
FIG. 5 is a perspective view on a reduced scale illustrating the principle of the invention in a multihull.

FIG. 5 of the drawings represent the inventive concept in multi-hull. In this form the boom and lateen yard are coupled together on a pivot at the bow of the center hull while the A frame mast is pivoted to the outrigger hulls. The struts as in the previously discussed embodiments, pivot to the mast and ride on cars and trackways on the outrigger hulls.

I claim:

1. A foldable mast assembly for a sailboat comprising a stub mast, a wishbone boom, said boom mounted upon the stub mast, as mast pivoted on the boom, struts having one end pivotally affixed to the mast, means slidably connecting the other end to the boom and means for pulling the struts along the boom.

2. A foldable mast assembly as in claim 1 wherein the mast is an A-frame.

3. A foldable mast assembly as in claim 1 wherein the means slidably connecting the struts is a track on the boom and a car engaging the track pivotally fastened to the struts.

4. A foldable mast assembly as in claim 1 wherein the mast is pivoted on the boom at a forward location and the struts extend aft.

5. A foldable mast assembly as in claim 1 wherein a lateen yard is pivotally anchored to the forward end of the boom.

6. A foldable mast assembly for a sailboat comprising a stub mast, means mounting the stub mast for rotative movement about a generally vertical axis relative to the sailboat, means mounting a mast for pivoting relative to the axis of the stub mast, a boom, means on the stub mast supporting the boom, struts pivoted to the mast and slidably coupled to the sailboat whereby the mast is supported in all positions by the struts.

7. A foldable mast assembly as in claim 6 wherein means are provided to pull the slidable coupling forward.

8. A foldable mast assembly for a sailboat comprising an A frame mast defining a pair of legs rising to an apex, each leg pivoted to a hull structure of a sailboat, a lateen yard supported by means at said apex of said legs and at one end pivoted at the bow to the hull, a pair of struts pivoted to the legs of the mast at one end thereof. The other end of each of the struts coupled to a car, a pair of spaced trackways on the hull structure of the sailboat, the said cars engaging a single trackway whereby the mast is supported by the struts in all positions and may be raised and lowered by moving the cars along the trackways.

* * * * *